United States Patent [19]

Lesek

[11] 4,063,492

[45] Dec. 20, 1977

[54] SHIPPING CARTON ERECTOR AND HOLDER

[75] Inventor: Arthur Lesek, Nashua, N.H.

[73] Assignee: H. W. Stark Co., Inc., Milwaukee, Wis.

[21] Appl. No.: 707,173

[22] Filed: July 21, 1976

[51] Int. Cl.[2] ..... B31B 5/02

[52] U.S. Cl. ..... 93/49 R; 53/374; 93/52

[58] Field of Search ..... 53/374, 390; 93/49 R, 93/36 R, 36.3, 52

[56] References Cited

U.S. PATENT DOCUMENTS

| | | | |
|---|---|---|---|
| 3,312,154 | 4/1967 | Pierce | 93/49 R |
| 3,358,567 | 12/1967 | Tucker et al. | 93/49 R |
| 3,426,502 | 2/1969 | Greenberg | 53/374 X |
| 3,477,349 | 11/1969 | Berney | 93/36.3 X |
| 3,948,152 | 4/1976 | Nolan et al. | 93/52 X |
| 4,018,143 | 4/1977 | Dice, Jr. et al. | 93/36.3 |

*Primary Examiner*—Roy Lake
*Assistant Examiner*—Paul A. Bell
*Attorney, Agent, or Firm*—Wheeler, Morsell, House & Fuller

[57] ABSTRACT

An elongated carton supporting rail is mounted on a frame along with means for guiding an opened-out upright carbon blank to a predetermined position, with the edges of its bottom minor flaps resting on the rail. Flap closing elements automatically engage the bottom minor and major flaps of the carton in sequence immediately following the engagement of the carton with a switch lever when the carton is in the proper position on the rail. The minor flaps are folded above the carton supporting surface of the rail and in parallelism therewith, and the major flaps are folded below the carton supporting surface of the rail. The carton is then filled while supported on the rail, and thereafter is engaged by a pushing element and slid longitudinally off the discharge end of the rail.

13 Claims, 8 Drawing Figures

SHIPPING CARTON ERECTOR AND HOLDER

BACKGROUND OF THE INVENTION

This invention relates to apparatus for automatically folding the bottom flaps of a carton and supporting the carton while it is being filled.

In the past, the process of opening carton blanks and folding up the bottom flaps preparatory to filling the carton was performed manually by one person. This process was awkward since both hands are required to fold the minor and major flaps upwardly, while at the same time the carton has to be supported in an upright position.

Apparatus has been proposed in the past to assist in the process of folding the carton's bottom flaps as disclosed in U.S. Pat. Nos. 2,739,513 and 2,255,954. However, this apparatus does not include a rail for holding and supporting the carton while it is being filled and discharged, and does not include means for folding the minor flaps of the carton into a position above the carton supporting surface of the rail while the major flaps are folded below the said carton supporting surface of the rail.

SUMMARY OF THE INVENTION

The apparatus of this invention includes a carton supporting rail which is mounted on a frame together with means for guiding the carton into operative position thereon. Flap closing elements are provided to automatically close the bottom flaps of the carton, the minor flaps being folded to a position of parallelism with and above the carton supporting surface of the rail, and the major flaps being folded below the said carton supporting surface. In the preferred embodiment, means is provided for pushing the carton longitudinally off the discharge end of the supporting rail after it has been filled.

DESCRIPTION OF THE PREFERRED EMBODIMENT

Figure 1:
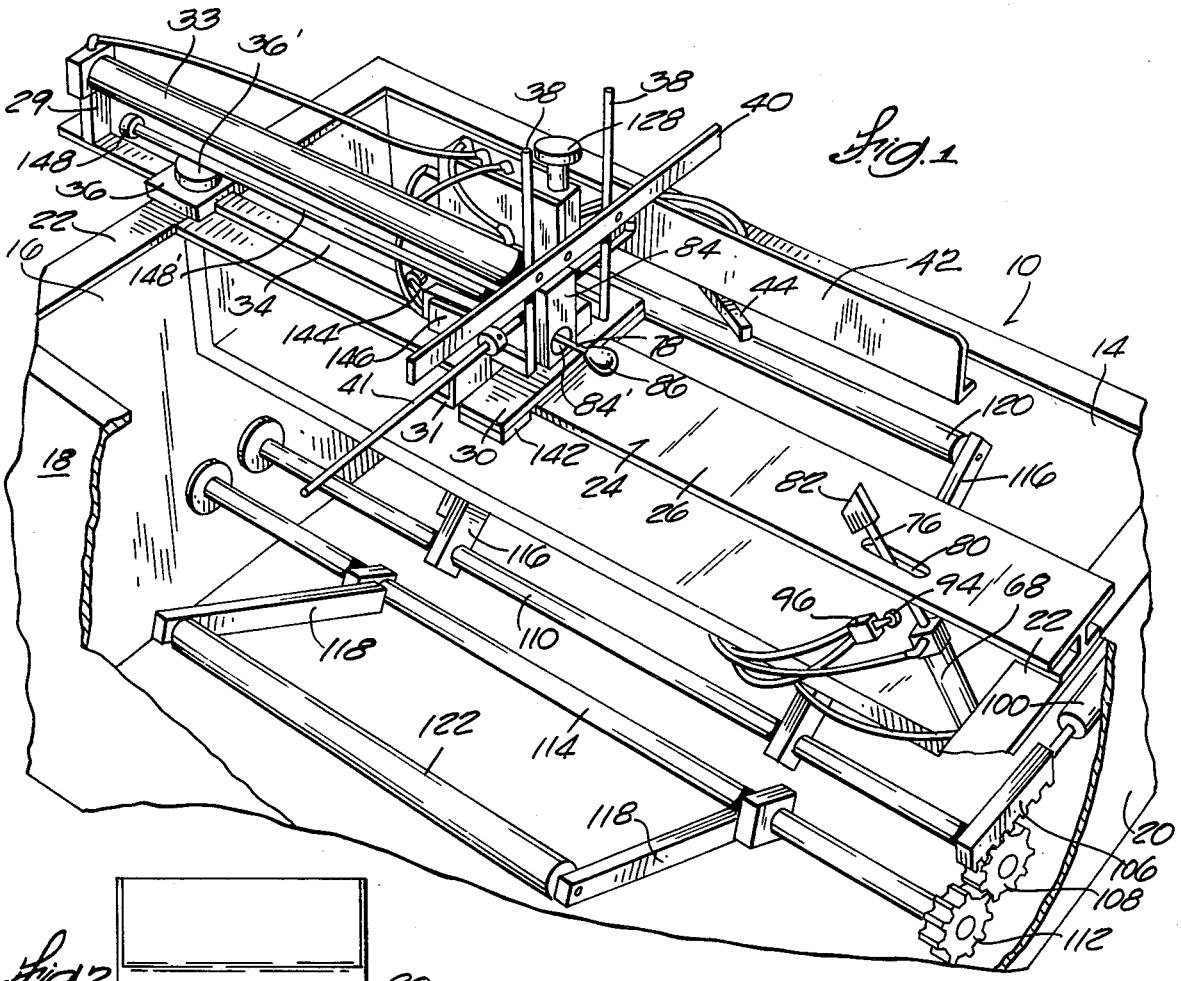
FIG. 1 is a partially cut away perspective view of one embodiment of the invention.
Figure 2:
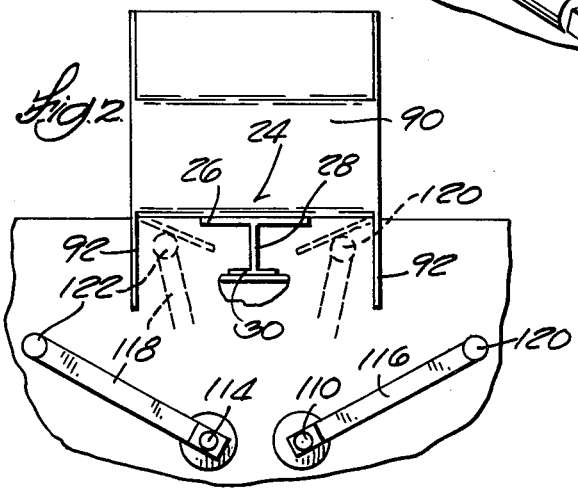
FIG. 2 is a diagrammatic cross-sectional view showing the operation of the major flap closing elements.

FIGS. 1 and 2 show the preferred embodiment which is mounted in a frame comprising an open-topped metal box 10 having a bottom 12 and having four upright walls, 14, 16, 18, and 20. The upper edges of sides 14–20 are provided with a rectangular rim 22. A carton supporting rail 24 is supported between the walls 16 and 20. Carton supporting rail 24 is preferably T-shaped in cross-section (see FIG. 2), having an upper horizontal carton supporting portion 26, a vertical center web 28, and a lower horizontal member 30 which is narrower than upper horizontal member 26. Referring to FIG. 1, the left hand end of upper horizontal portion 26 of the rail is flush with rim 22 while the right hand end of upper horizontal portion 26 is raised above rim 22 to permit a carton which is resting on rail 24 to be slid off of rail 24 from left to right in FIG. 1, while the carton's major flaps are folded up under the horizontal portion 26 of rail 24. Thus the right hand end of rail 24 in FIG. 1 constitutes the discharge end of the rail.

Adjustable carton guiding and positioning means includes a slide 31 (FIGS. 1 and 8) which is slideable on rail 24. The slide is connected to the inner end of a bar 34 which is slideable in a clamp 36 on the rim 22 of wall 16. Supported at one end by a post 29 on the bar 34, and at its other end on the slide 31, is a cylinder 33 having a piston 126. Also suitably supported on the slide 31 is a small piston 70 having its piston rod connected to a flap pushing element 86. Projecting forwardly from slide 31 are brackets 37 which support upright rods 38. these rods support a transverse carton guide 40. A transversely adjustable rod 41 supports a longitudinal guide 42. When hand nut 36′ is loosened, the assembly above described may be adjusted in a longitudinal direction to adjust the position of box guide 40 along the rail.

Figure 7:
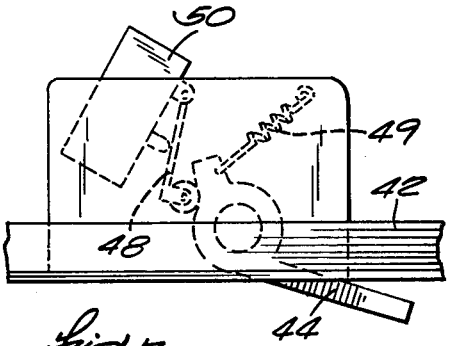
FIG. 7 is a detail plan view of the pneumatic switch and switch actuating lever which initiates action of the flap closing elements.

Other guides may be mounted on posts 38 above guide rails 40 but are omitted in FIG. 1 for better disclosure of the parts. A switch lever 44 (FIGS. 1 and 7) is rockably mounted on guide 42 in position to be moved by a carton when it comes to rest against lever 44. Lever 44 has an end 46 (FIG. 7) which coacts with the actuating lever 48 of a pneumatic switch 50 to initiate the process of automatically closing the bottom flaps when lever 48 is fully depressed. Switch lever 44 is spring biased away from actuating lever 48 by a spring 49.

Figure 6:
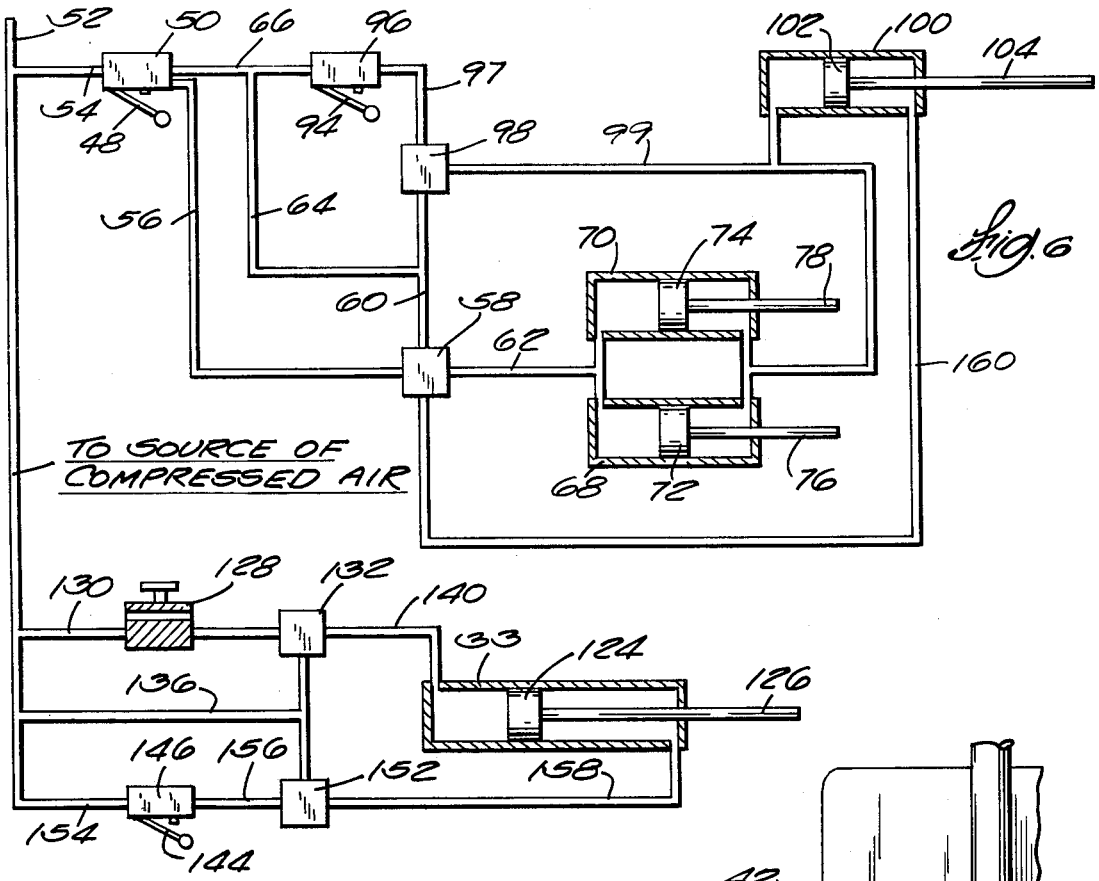
FIG. 6 is a schematic pneumatic circuit diagram for the embodiment of FIG. 1.

The pneumatic circuit for automatically closing the carton flaps and pushing the loaded carton off carton supporting rail 24 is shown in FIG. 6. Pneumatic switch 50 is a conventional normally closed pneumatic switch which opens when its actuating lever 48 is fully depressed. This occurs when a side wall of an opened out carton blank depresses switch lever 44, thus signifying that the carton is in position to have its flaps folded.

When pneumatic switch 50 closes, it sends a pulse of compressed air from conduit 52, which is coupled to a conventional source of compressed air, through conduit 54 and conduit 56 to pneumatic relay 58 which, when triggered by a pulse, allows compressed air from conduits 56, 64, and 60 to enter conduit 62. Conduit 56 receives compressed air from switch 50. The compressed air from conduit 62 is applied to one side of two double acting pneumatic cylinders 68 and 70, having pistons 72 and 74, respectively, and piston rods 76 and 78, respectively. The physical location of cylinder 68 is on the right hand side of FIG. 1 below carton supporting rail 24, with the piston rod 76 extending through a slot 80 in rail 24 and having a flap engaging element 82.

Figure 3:
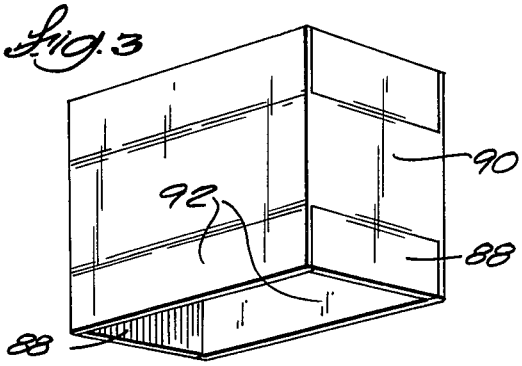
FIG. 3 is a perspective view of an opened-out carton blank.
Figure 4:
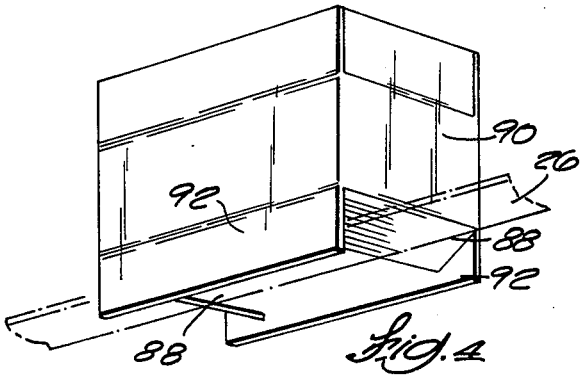
FIG. 4 is a perspective view of an opened-out carton blank with the bottom minor flaps partially folded inwardly, the rail being shown in broken lines.
Figure 5:
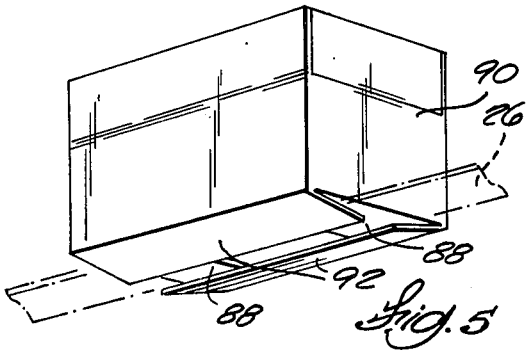
FIG. 5 is a perspective view of an opened-out carton blank with both pairs of bottom flaps folded up around the rail, the latter being shown in broken lines.
Figure 8:
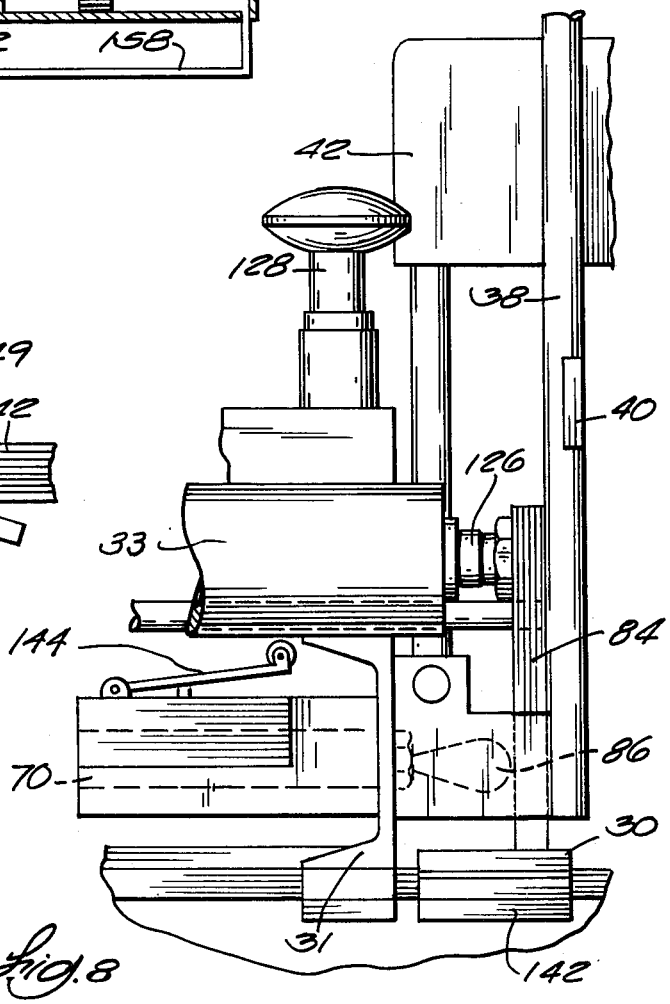
FIG. 8 is a fragmentary detail side view showing the box holding means, the box pusher cylinder, and one of the minor flap closing elements.

Cylinder 70 is supported on slide 31 (see FIG. 8). A slide 30 which is adapted to be moved by piston 126 carries a block 84 with an opening 84′ (FIG. 1) therein through which piston rod 78 may extend. Piston rod 78 carries the flap engaging element 86. When piston rods 76 and 78 are moved outwardly by the compressed air applied to cylinders 68 and 70, flap engaging elements 82 and 86 push against the bottom minor flaps 88 (FIG. 3) of an opened out carton 90, the edges of which flaps are resting on the carton supporting surface 26 of rail 24, and folds flaps 88 inwardly toward each other as shown in FIG. 4, thus allowing carton 90 to descend to a position shown in FIG. 2 where rail 24 is between the major flaps 92. The descent of carton 90 is caused by a slight downward pressure on carton 90 by the person operating the machine.

When the piston rod 76 of cylinder 68 is fully extended, it closes the actuating lever 94 (FIG.1) of another normally closed pneumatic switch 96 (FIGS. 1 and 6) which sends a pulse through conduit 97 to a pneumatic relay 98 (FIG. 6) which, when triggered by a pulse of compressed air, allows compressed air from conduit 60 to enter conduit 99. The latter is coupled to the other end of cylinders 68 and 70 and causes the piston rods 76 and 78 thereof to retract, and cause flap engaging elements 82 and 86 to return to their initial position. The initial position of flap engaging element 86 is shown in solid lines in FIG. 8, while the extended position thereof is shown in broken lines.

Closure of pneumatic switch 96 also applies compressed air to one end of a double acting pneumatic cylinder 100, the latter having a piston 102 and piston rod 104. Cylinder 100 is mounted on a wall 20 of frame 10, at the far right hand side of FIG. 1. A rack 106 is attached to piston rod 104 to operate pinion gears 108 and 112 which operate rock shafts 110 and 114. Rock shafts 110 and 114 are rockably mounted on frame 10 by conventional means and carry arms 116 and 118, respectively, which support flap engaging rollers 120 and 122. As rack 106 is extended outwardly from cylinder 100, gears 108 and 112 cause arms 116 and 118 and rollers 120 and 122 to be rocked upwardly toward each other, thereby striking major flaps 92 and folding them upwardly toward each other under carton supporting element 26 as shown in broken lines in FIG. 2.

It should be noted that minor flaps 88 are folded to positions above carton supporting element 26 while major flaps 92 are folded below carton supporting element 26 and serve to hold carton 90 in place on carton supporting element 26.

Carton 90 remains on carton supporting element 26 while it is manually filled, after which it is automatically slide longitudinally off of the discharge end of rail 24 (the right hand end thereof in FIG. 1) by double acting cylinder 33 (FIGS. 1 and 6) having a piston 124 (FIG. 6) and piston rod 126 which is connected to base 30 to move the same longitudinally (FIG. 8). Cylinder 33 is controlled by a manual pneumatic switch 128 (FIGS. 1) and 6) which, when pressed, allows a pulse of compressed air to flow from conduits 52 and 130 to pneumatic relay 132 via conduit 134. Relay 132 then couples compressed air from conduits 52, 136, and 138 to conduit 140 which is connected to one side of cylinder 33 and causes piston rod 126 to extend therefrom and move carton holding base 30 longitudinally toward the discharge end of rail 24. This pushes the filled carton 90 longitudinally off of the discharge end of rail 24 onto conveyor means (not shown) which carries carton 90 to flap sealing apparatus or the like. Base 30 has spaced underlying portions 142 (FIGS. 1 and 8) which span carton supporting rail 26 so as to bear against the edges of major flaps 92 to prevent crushing the end of carton 90 when it is slid off the discharge end of carton supporting rail 24.

When piston 126 of cylinder 33 has been fully extended, the actuating lever 144 (FIGS. 1 and 6) of pneumatic limit switch 146 is engaged by a collar 148 (FIG. 1) on rod 148'. The latter is connected at its inner end with block 84 to move therewith.

Closure of pneumatic switch 146 allows a pulse of compressed air to flow to a pneumatic relay 152 through conduits 52, 154, and 156. When relay 152 is actuated by said pulse, it applies compressed air to the other end of cylinder 33 through conduits 138 and 158, thereby causing piston rod 126 to retract and bring carton supporting base 30 back to its initial position.

At the end of the unloading cycle when the filled carton 90 has been slid off carton supporting rail 24, the major flap closing arms 116 and 118 and their flap engaging rollers 120 and 122 are in their fully raised position and remain in this position until relay 58 is actuated to fold the minor flaps of the next carton 90 upwardly, at which time compressed air is conducted from conduit 56 (FIG. 6) through conduit 160 to the end of cylinder 100 which causes piston rod 104 to return to its retracted position, thus lowering flap engaging rollers 120 and 122.

The above-described operating cycle is repeated for each successive carton 90 which is placed on carton supporting rail 26, each box being guided along guide 40 until it hits guide 42.

Various changes and modifications may be made without departing from the spirit of the invention , and all of such changes are contemplated as may come within the scope of the claims.

What I claim is:

1. An erector and holder for a shipping carton having first and second pairs of closure flaps comprising a frame, an elongated rail mounted on said frame, said rail having a carton supporting surface and having a discharge end, means on said frame for holding an opened-out carton blank in a predetermined upright position with the edges of said first pair of flaps resting on said rail, means for folding said first pair of flaps inwardly toward one another on top of said carton supporting surface to allow the carton to descend to a position where said rail is between the second pair of flaps, and means adjacent opposite sides of said rail and movable toward said rail for folding said second pair of flaps inwardly toward one an other to dispose them below the supporting surface of said rail while said first pair of flaps continue resting on said top surface, with said rail forming a slide for discharge of the carton from said discharge end.

2. The carton erector and holder of claim 1 wherein said rail is T-shaped in cross-section.

3. The carton erector and holder of claim 1 wherein said carton holding means includes a portion which is adjustable to accommodate cartons of varying size.

4. The carton erector and holder of claim 3 wherein said carton holding means includes portions which are adjustable in two directions at right angles to each other.

5. The carton erector and holder of claim 1 and also including means for pushing said carton longitudinally of said elongated rail to the discharge end thereof while the rail is between said pairs of flaps.

6. The carton erector and holder of claim 1 and also including switch means on said carton holding means positioned to be actuated when an opened-out carton blank is properly positioned in said carton holding means, and means responsive to actuation of said switch for causing the folding of said first pair of flaps.

7. The carton erector and holder of claim 6 and also comprising a second switch means, means for actuating said second switch means after said first pair of flaps has been folded inwardly, and means responsive to actuation of said second switch means for folding said second pair of flaps inwardly.

8. The carton erector and holder of claim 5 and also comprising means for automatically returning said carton pushing means to its initial position after said carton has been pushed off the discharge end of said rail.

9. The carton erector and holder of claim 1 wherein said means for folding said second pair of flaps inwardly comprises a pair of swingable members positioned to contact said second pair of flaps below said rail.

10. The carton erector and holder of claim 9 wherein said rail is T-shaped in cross-section and has a central web, and wherein one of said swingable members is swingable to a position on one side of said web while the other swingable member is swingable to a position on the other side of said web.

11. The carton erector and holder of claim 10 wherein each of said swingable members is mounted on a rock shaft, and further comprising means for simultaneously rocking said rock shafts.

12. The carton erector and holder of claim 11 wherein said means for simultaneously rocking said rock shafts comprises rack and pinion means coupled to said shafts, a fluid pressure actuated means including a cylinder and piston for moving the rack of said rack and pinion, and means for selectively actuating said fluid pressure actuated means.

13. The carton erector and holder of claim 1 in which there is a pneumatic circuit, in which the means for folding said first pair of flaps inwardly is in said circuit and includes pneumatically actuated folding elements, in which the means for folding the second pair of flaps inwardly is in said circuit and includes pneumatically actuated folding elements, and in which there is pneumatically actuated pushing means in said circuit for causing discharge of the carton from the rail.

* * * * *